US005584083A

United States Patent [19]

Ramsey et al.

[11] Patent Number: 5,584,083

[45] Date of Patent: Dec. 17, 1996

[54] MATTRESS SPRING CORE

[75] Inventors: Henry R. Ramsey, Dudley; Wayne J. Provost, Oxford, both of Mass.; Thomas J. Wells, Carthage, Mo.

[73] Assignee: L&P Property Management Company, Chicago, Ill.

[21] Appl. No.: 456,777

[22] Filed: Jun. 1, 1995

[51] Int. Cl.[6] ..... A47C 25/00

[52] U.S. Cl. ..... 5/271; 5/269; 5/256; 5/716; 267/91

[58] Field of Search ..... 5/267, 269, 271, 5/272, 248, 256, 475; 267/91

[56] References Cited

U.S. PATENT DOCUMENTS 1,887,058 11/1932 Karr ..... 5/256 X
3,653,082 4/1972 Davis ..... 5/475 X
4,609,186 9/1986 Thoenen .
4,726,572 2/1988 Flesher et al. ..... 267/91
4,781,360 11/1988 Ramsey .
4,817,924 4/1989 Thoenen .

*Primary Examiner*—Michael F. Trettel
*Attorney, Agent, or Firm*—Wood, Herron & Evans, P.L.L.

[57] ABSTRACT

A spring core for a mattress consisting of a plurality of side-by-side rows of identically configured helical coil springs each made of a single piece of wire having a central portion of a first radius defining a central spring axis and terminating at opposing ends with unknotted upper and lower end turns disposed in planes substantially perpendicular to the spring axis. The springs are connected with each other at their upper and lower turns by connecting lacing wires. The upper and lower turns are each substantially U-shaped, having a longer relatively straight leg and a shorter arcuate leg located at the free end of each end turn, the legs connected to each other by a base web. The radius of the shorter arcuate leg is substantially less than the first radius of the central portion of each coil spring. All the coil springs are oriented in the same direction, except along an edge region of the spring core.

8 Claims, 2 Drawing Sheets

MATTRESS SPRING CORE

FIELD OF THE INVENTION

This invention relates to a spring core for a mattress, and more particularly, to a spring core made up of identically formed coil springs arranged in side-by-side rows, each coil spring being made of a single piece of wire having a central spiral portion terminating in upper and lower unknotted end turns with adjacent helical coil springs being joined together at their end turns by a helical lacing wire.

BACKGROUND OF THE INVENTION

Traditionally, spring cores for mattresses have consisted of a plurality of spaced parallel rows of helical coil springs mounted between border wires; coil springs adjacent the border wires being attached thereto via helical connecting wires, sheet metal clips or other connections. The upper and lower end turns of adjacent springs are generally connected to each other by helical lacing wires; the helical lacing wires being transverse or perpendicular to the columns of coil springs. Coil springs in each row are disposed in rectilinear relation to each other so as to form spaced parallel rows of springs within the border wires.

The upper and lower end turns of unknotted coil springs often are made with straight portions or legs which abut one another when coils are placed next to each other. For example, in U.S. Pat. No. 4,781,360, the end turns have deviations or offsets straightening the curved portion of the end turn so as to enable adjacent end turns to be laced together. Alternatively, the coil end turns may be rectangular with two opposite straight legs, as in German Patent No. 3,321,991. Adjacent coil springs are connected to each other at their end turns, both upper and lower, by helical lacing wire. One leg of a U-turn of an end turn of a coil spring is set beside the opposite leg of the U-shaped end turn of the adjacent coil spring. The side-by-side legs are laced together with helical lacing wire.

However, when assembled, coil springs of such a spring core may move within the lacing wire, causing misalignment or nonparallel alignment of coils in adjacent rows of coils. This misalignment causes the coil springs to line up improperly. The lines connecting the central axes of the coil springs no longer form a 90° angle as they should. This misalignment thus changes a rectangular or square spring core into a rhombus. Such an odd shape must be then corrected at an additional cost.

In order to avoid this misalignment problem, spring cores were developed having individual coil springs with U-shaped end turns having one leg of a greater length than its opposing leg, as in U.S. Pat. No. 4,817,924. Once again, adjacent coil springs were connected with helical lacing wire at their end turns. However, due to the difference in leg lengths of each U-turn, the lacing wire wrapped one more time around the longer leg of the U-shaped end turn coil and one less turn around the immediately adjacent shorter leg of the adjacent end turn. The different leg lengths bound together with helical lacing wire corrected the misalignment or coil offset problem.

In U.S. Pat. No. 4,817,924, the longer leg of each U-shaped end turn is disclosed as being spaced further from the central portion of the helical spring or the axis of the spring than the distance between the short leg and the central portion or axis of the helical spring. The purpose of such spacing is to eliminate interference and noise when a load is placed on the spring core causing compression of the helical springs.

When springs are made in accordance with the disclosure of U.S. Pat. No. 4,817,924, problems may exist during manufacture. For example, because both legs of the U-shaped end turns are relatively straight, the coils may move or be skewed within the assembly machine dies prior to lacing the helical springs together. Movement or improper seating, such as results from skewing of the helical springs within the dies causes jambs and similar problems when lacing the end turns of the coils together.

It has therefore been an objective of this invention to eliminate any skewing or misalignment problems with end turns of unknotted coils within the assembly machine dies of a lacing and assembly machine.

It has been another objective of this invention to enable end turns which are to be assembled together to be more consistently gripped and positioned next to one another for lacing during the assembly of coils.

It has been another objective of this invention to provide a spring core in which the top and bottom U-shaped end turns of adjacent coil springs are bound together more tightly within or inside helical lacing wires.

It has been another objective of this invention to provide trouble-free manufacturing and assembly of unknotted coil springs by forming a small radius on the free end of each end turn of the unknotted coils, thereby reducing jambs within the assembly machine and, ultimately, cost of the resulting assembled product.

SUMMARY OF THE INVENTION

The invention of this application which accomplishes these objectives comprises a spring core for a mattress made up of a plurality of identically configured helical coil springs. Each helical coil spring is made of a single piece of wire and has a central portion of a first radius defining a central spring axis and terminating in opposing unknotted upper and lower generally U-shaped end turns, each disposed in a plane substantially perpendicular to the spring axis. The springs are arranged in side-by-side rows connected with each other at the upper and lower end turns by helical lacing wires. The helical lacing wires run perpendicular or transversely to the columns or rows of springs and are arranged in the planes of the upper and lower end turns. Each upper and lower end turn is substantially U-shaped, having a longer relatively straight leg and a shorter arcuate leg connected to each other by a base web. The shorter arcuate leg is located at the free unknotted end of each end turn and has a radius substantially less than the first radius of the central portion of the helical coil spring. Both the long and the short legs of each end turn are laterally outwardly spaced from the central portion of the coil spring. The spacing between the longer leg of each U-shaped end turn and the central portion of the coil spring is less than the corresponding spacing between the central portion of the coil spring and the associated shorter leg of the same end turn. The corresponding upper and lower end turns of each coil spring are rotated approximately 180° in relation to each other to dispose the shorter and longer legs of the upper end turn of each spring in mirror symmetry to the shorter and longer legs respectively of the associated lower end turn.

Forming the free end of the coil with a relatively small radius enables the spring to be easily formed, and subsequently, easily assembled. The radius on the smaller leg enables more dimensional stability and enables the coils to be tighter within the helical lacing wire. The radius tends to spring back to its original shape after the helical passes through the lacing jaw, tightening itself against the helical connecting spring.

These and other objects and advantages of the invention will be more apparent from the following description of the drawings in which:

DETAILED DESCRIPTION OF THE INVENTION

Figure 1:
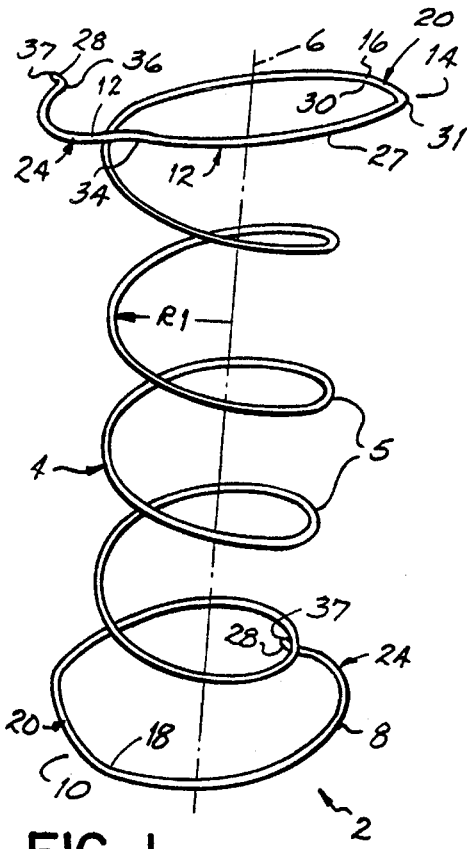
FIG. 1 is a perspective view of a helical circular spring of the present invention.

With reference first to FIG. 1, there is illustrated a helical coil spring 2 having a central spiral portion 4 made up of a plurality of consecutive helical loops or revolutions 5 defining a central spring axis 6 and terminating in a lower end turn 8 and an upper end turn 12. Lower end turn 8 is disposed substantially in plane 10 which is substantially perpendicular to the central spring axis 6. The upper end turn 12 is disposed substantially in plane 14 which is again substantially perpendicular to the central spring axis 6. The two end turns 8 and 12 are alike so that a description of one end turn will suffice for both. The end turns 8 and 12 are aligned relative to the spring axis 6, one on top of the other. Each helical coil spring is made of a single piece of wire. The active length of the helical coil spring wire which determines the spring or resilient property of the coil extends from position 16 of the upper end turn down to position 18 of the lower end turn 8.

Figure 2:
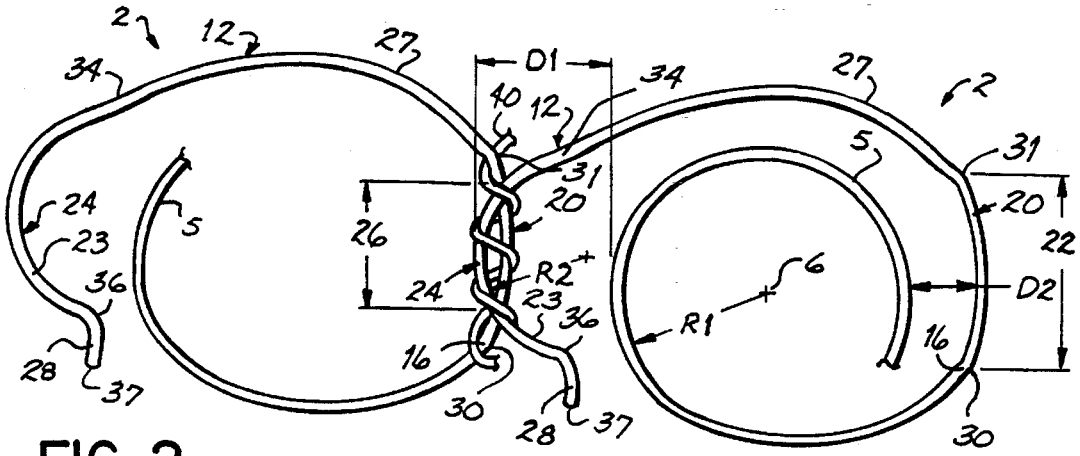
FIG. 2 is a top plan view of two adjacent end turns of adjacent helical coil springs connected to each other via connecting helical lacing wire.

Referring to FIG. 2, it will be seen that each end turn is generally U-shaped, having a longer relatively straight leg 20 of a length 22 and shorter arcuate leg 24 of a length 26. The longer relatively straight leg 20 and the shorter arcuate leg 24 are connected to each other by a base web 27 and a portion of an arcuate section 23, the shorter arcuate leg 24 and the arcuate section 23 being located on the free unknotted end of each of the end turns. The arcuate section 23 and the shorter arcuate leg 24 both have a common radius R2 which is substantially less than the first radius R1 of the central spiral portion of each helical coil spring 2. In the preferred embodiment of the invention, the first radius R1 of the central portion of each coil spring is approximately 15/16 inch whereas the radius R2 of the arcuate section 23 and the shorter arcuate leg of the U-shaped end is approximately 5/8 inch.

Both legs of the U-shaped end turns are laterally spaced from the central spiral portion 4 of the helical coil spring 2. Both the shorter arcuate leg 24 and the longer relatively straight leg 20 are spaced laterally outward from the central portion 4 of the coil spring 2. The spacing D2 between the longer leg 20 and the central portion 4 of the coil spring is less than the corresponding spacing D1 between the central portion 4 of the coil spring and the associated shorter arcuate leg 24 of the same end turn. These spacings D1 and D2 ensure that even under an extreme load on helical circular spring 2 the end turns do not come in contact or clash with the central portion 4 of the coil spring.

Referring to FIG. 2, the central portion 4 of each helical coil spring loops upward until it reaches a first bend 30 on the upper end turn 12. The first bend 30 connects the longer relatively straight leg 20 to the central portion of the coil spring 4. The longer relatively straight leg 20 terminates in a second bend 31. The longer relatively straight leg 20 is not perfectly straight but rather is slightly arcuate. The second bend 31 connects the longer relatively straight leg 20 with the base web 27 which is slightly curved. At the opposite end of the base web 27 there is a third bend 34 with which one end of the arcuate section 23 connects. The shorter arcuate leg 24 is bent much more than the longer relatively straight leg 20 or the central portion 4 of the helical coil spring 2. The shorter arcuate leg 24 has a length 26 which is less than the length of its corresponding longer leg 20, length being defined for this purpose as the dimension contained within the helical lacing wire 40. At the other end of the arcuate section 23 is a fourth bend 36 which connects the arcuate section 23 to a straight tail piece 28 having an end 37. The tail piece 28 of the top turn is bent downward out of the plane 14 in order to avoid puncture of the upholstery which covers the mattress spring core. The tail piece 28 of each end turn is also slanted inward towards the central spring axis 6. The tail piece 28 of each end turn is bent inwardly towards the middle of the spring core in order to avoid puncturing the upholstery which covers the spring core.

Figure 3:
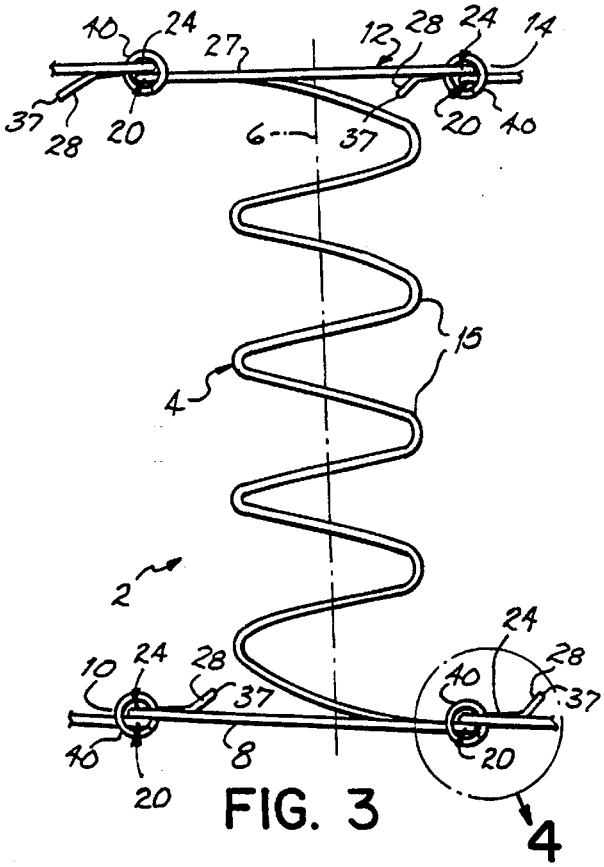
FIG. 3 is a side view, partially broken away, of two adjacent helical coil springs shown in FIG. 3 as encircled area 4.
Figure 4:
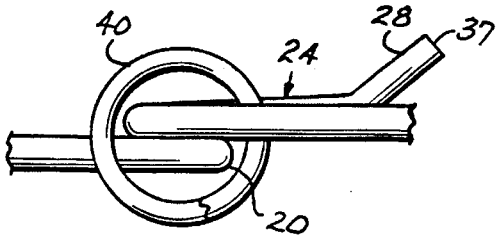
FIG. 4 is an enlarged view of the connection between helical coil springs.

The significance of the bent straight tail piece 28 is evident from FIG. 3. In FIG. 3, it can be seen that the tail piece 28 is bent at the fourth bend 36 inward in the direction of the central spiral portion 4 of the coil spring so that it does not fray the upholstery nor contact the central portion 4 of the coil spring.

The lower end turn 8 is formed in an identical manner to the upper end turn 12 except the lower end turn is rotated approximately 180° in relation to the upper end turn 12 to dispose the longer and shorter legs of the upper end turn 12 of the coil spring in mirror symmetry to the longer and shorter legs, respectively, of the associated lower end turn 8.

FIGS. 2–5 show the method of interconnection of adjacent coil springs. Adjacent coil springs are connected to one another at the upper and lower end turns by helical lacing wire 40 as shown in FIG. 3. The helical lacing wires 40 attach the longer relatively straight leg 20 of one end turn with a corresponding shorter arcuate leg of an adjacent end turn. As can be seen in FIG. 2, the helical lacing wire 40 circles the longer leg 20 four times but only circles the shorter arcuate leg three times. Such an assembly prevents an offset or axial misalignment of the springs during formation of the spring core and enables the manufacturer to create a rectangular spring core.

During the assembly lacing process, the shorter arcuate leg of the end turn, having a small radius R2 on the free end, is entrapped between a pair of opposed lacing jaws or dies which flatten the shorter arcuate leg to ease or facilitate the lacing process. Upon the release of the shorter arcuate leg by the lacing jaws, the shorter arcuate leg returns to its more rounded configuration so that both the longer and shorter legs of adjacent end turns press outwardly against the inner surface of the helical lacing wire 40, creating a tight fit inside the helical lacing wire 40.

Figure 5:
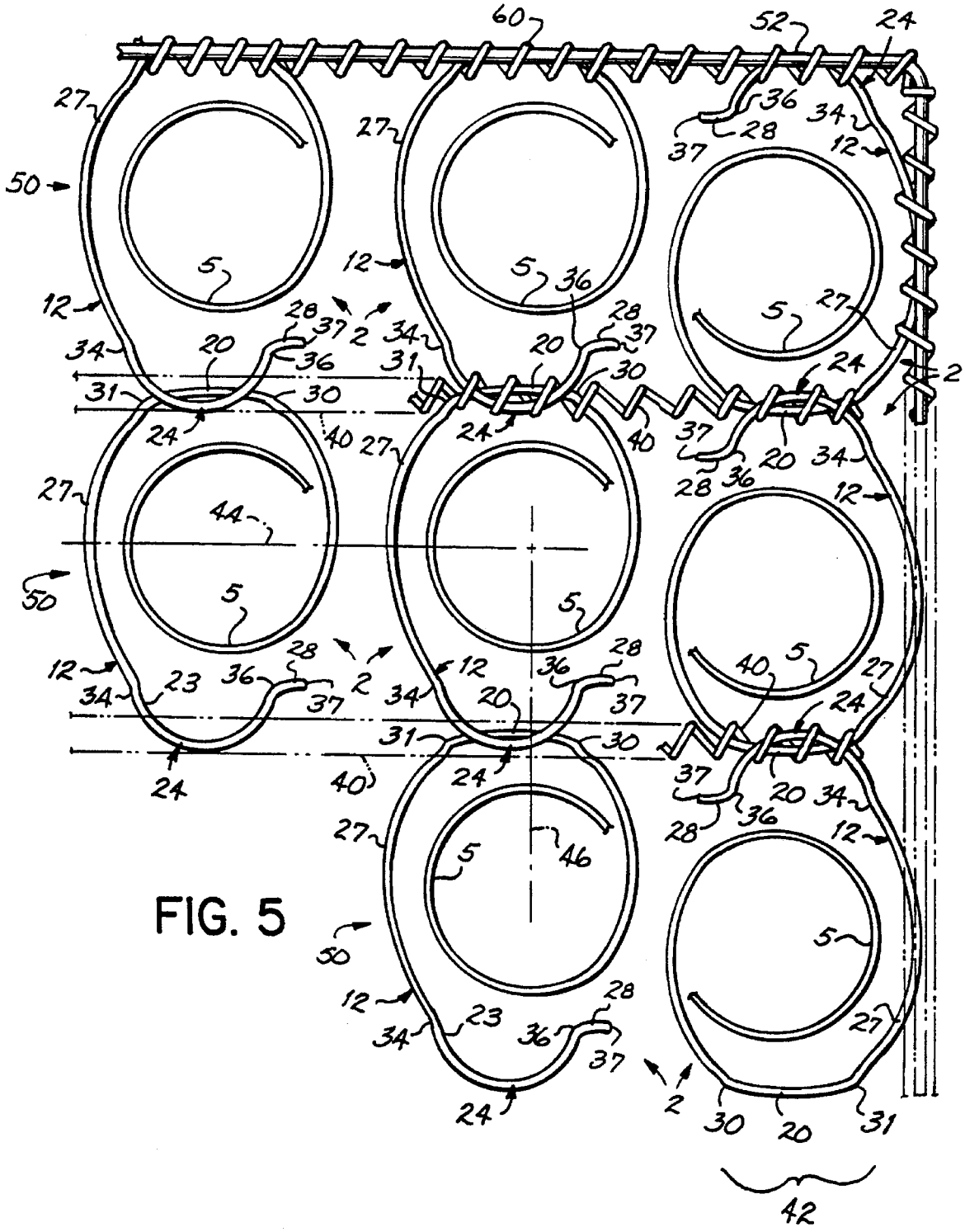
FIG. 5 is a top view of a corner of the spring core of the present invention.

FIG. 5 shows the arrangement in rows and columns of the helical coil springs 2. The coil springs 2 are arranged in side-by-side rows 50 and are connected with each other at the upper and lower end turns by helical lacing wires 40. Helical coil springs 2 are arranged in like orientation such that the base web 18 always forms the outer edge of the spring core, abutting border wire 52

In the endmost columns 42 of the spring core the helical coil springs are turned around so that the end turn normally at the top is now at the bottom. This avoids the problem of having the straight tail piece 28 facing the edge of the spring core.

In the central portion of the spring core (other than the endmost column), the rows are aligned horizontally so that the central spring axes of adjacent coil springs form a horizontal line 44. Likewise, the central spring axes of adjacent coil springs form a vertical line 46. The connecting lines 44 and 46 intersect at a right angle so that the edge sides of the spring core form right angles. Due to the formation of these right angles, offset or misalignment is eliminated and no corrections need be made. The spring core is surrounded in the top and bottom planes by upper and lower border wires 52. A helical connecting spring 60 fastens the helical coil springs 2 to the border wires 52 around the edge of the spring core. Alternatively, metal clips or other conventional fasteners may be used to connect the top and bottom end turns of the endmost coils of the spring assembly to the border wires 52.

By creating the spring core as described above, a sturdy mattress core may be easily machine assembled within an assembly machine. Because of the unique configuration of the end turns of the unknotted coils, repeated accurate positioning of the end turns of coils within the lacing jaws of the assembly machine is facilitated and machine jambs because of misalignment is minimized.

While we have described only a single preferred embodiment of our invention, we do not intend to be limited except by the scope of the appended claims.

We claim:

1. A spring core for a mattress, comprising a plurality of identically configured helical coil springs each made of a single piece of wire having a central spiral portion of a first radius defining a central spring axis and terminating at opposing ends with unknotted upper and lower end turns disposed in planes substantially perpendicular to said spring axis, said coil springs being arranged in side by side rows and connected with each other at said upper and lower end turns by connecting helical lacing wires arranged in said planes, said upper and lower end turns each being substantially U-shaped and having a longer relatively straight leg and a shorter arcuate leg, said shorter arcuate leg being located at the free unknotted end of each of said end turns and being of substantially less radius than said first radius of said central spiral portion of said circular springs, said legs of each end turn being laterally outwardly spaced from said central spring axis, the radial spacing between said longer leg and said central spring axis being less than the corresponding spacing between said central spring axis and said associated shorter leg of the same end turn, the opposing end turns of each spring being rotated approximately 180 degrees in relation to each other to dispose the longer and shorter legs of the upper end turn of each coil spring in mirror symmetry to the longer and shorter legs, respectively, of the associated lower end turn.

2. A spring core as defined in claim 1, wherein said central spiral portion is of a radius approximately 50% greater than the radius of said shorter arcuate leg.

3. The spring core as defined in claim 1, wherein a helical lacing wire encircles one of said longer relatively straight legs of a U-shaped end turn four times and encircles one of said adjacent shorter arcuate legs of an adjacent U-shaped end turn three times.

4. The spring core as defined in claim 1, wherein said shorter arcuate leg of each U-shaped end turn terminates in a straight tail piece bent inwardly toward the central portion of each coil spring out of the plane of the corresponding end turn.

5. The spring core as defined in claim 1 wherein each of said coil springs is oriented in similar fashion except for coil springs immediate adjacent opposed ends of the border wire of the spring core.

6. A spring core for a mattress comprising a plurality of side-by-side rows of identically configured helical coil springs each make of a single piece of wire having a central portion of a first radius defining a central spring axis and terminating at opposing ends with unknotted upper and lower end turns disposed in planes substantially perpendicular to the spring axis, each end turn terminating in a free end, adjacent springs of said spring core being connected at their upper and lower turns by connecting lacing wires, said upper and lower turns each being substantially U-shaped and having a longer relatively straight leg and a shorter arcuate leg;

said spring core being characterized by having the shorter arcuate leg at the free end of each end turn and said shorter arcuate leg having a radius which is substantially less than the first radius of the central portion of each coil spring.

7. The spring core of claim 6 being further characterized by each of said coil springs having the shorter arcuate legs spaced a greater radial distance from central spring axes than said longer relatively straight legs are spaced from said axes.

8. An unknotted wire spring for use in forming a spring core for a mattress, said spring comprising a single piece of wire having a central spiral portion of a first radius defining a central spring axis and terminating at opposing ends in unknotted upper and lower end turns disposed in planes substantially perpendicular to said spring axis, said upper and lower end turns each being substantially U-shaped and having a longer relatively straight leg and a shorter arcuate leg, said shorter arcuate leg being located at the free unknotted end of each of said end turns and being of substantially less radius than said first radius of said central spiral portion of said circular springs, said legs of each end turn being laterally outwardly spaced from said central spring axis, the radial spacing between said longer leg and said central spring axis being less than the corresponding spacing between said central spring axis and said associated shorter leg of the same end turn, the opposing end turns of each spring being rotated approximately 180 degrees in relation to each other to dispose the longer and shorter legs of the upper end turn of each coil spring in mirror symmetry to the longer and shorter legs, respectively, of the associated lower end turn.

* * * * *